US006743987B1

(12) United States Patent
Remmert et al.

(10) Patent No.: US 6,743,987 B1
(45) Date of Patent: Jun. 1, 2004

(54) REMOVAL DETERRENCE STRUCTURE FOR A MECHANICAL INTERLOCK

(75) Inventors: Scot Eugene Remmert, Mt. Pulaski, IL (US); Julie Cathryn Jurgens, Bloomington, IL (US)

(73) Assignee: Baton Corporation, Cleveland, OH (US)

( * ) Notice: Subject to any disclaimer, the term of this patent is extended or adjusted under 35 U.S.C. 154(b) by 0 days.

(21) Appl. No.: 10/324,754

(22) Filed: Dec. 19, 2002

(51) Int. Cl.[7] ..... H01H 9/26
(52) U.S. Cl. ..... 200/50.33
(58) Field of Search ..... 200/50.32–50.4, 200/50.01, 50.02, 50.2

(56) References Cited

U.S. PATENT DOCUMENTS

| | | | | |
|---|---|---|---|---|
| 3,562,452 A | | 2/1971 | Keogh et al. | |
| 4,286,242 A | | 8/1981 | Mrenna et al. | |
| 4,924,041 A | | 5/1990 | Yee | 200/50.33 |
| 5,130,501 A | | 7/1992 | Maeda | 200/50.33 |
| 5,341,191 A | | 8/1994 | Crookston et al. | |
| 5,393,942 A | * | 2/1995 | Reiner et al. | 200/50.4 |
| 5,397,868 A | | 3/1995 | Smith et al. | |
| 5,436,415 A | | 7/1995 | Smith et al. | |
| 5,902,974 A | | 5/1999 | Fogle et al. | |
| 5,977,492 A | | 11/1999 | Taylor et al. | |
| 6,043,439 A | | 3/2000 | Crooks et al. | |
| 6,069,328 A | | 5/2000 | Oravetz et al. | 200/50.33 |

* cited by examiner

*Primary Examiner*—Renee Luebke
(74) *Attorney, Agent, or Firm*—Martin J. Moran

(57) ABSTRACT

A removal deterrence structure for a pair of circuit breaker disposed in an enclosure having an interlock assembly. A pair of circuit breakers are disposed within the enclosure. The interlock assembly is also disposed within the enclosure and structured to allow only one of the circuit breakers to be closed at a time. The interlock assembly is coupled to the circuit breakers by fasteners that cannot be decoupled from the circuit breakers unless the enclosure is disassembled.

6 Claims, 5 Drawing Sheets

REMOVAL DETERRENCE STRUCTURE FOR A MECHANICAL INTERLOCK

BACKGROUND OF THE INVENTION

1. Field of the Invention

This invention relates to an interlock assembly for a pair of circuit breakers and, more specifically, to a removal deterrence structure for an interlock assembly wherein the interlock assembly cannot be removed while the enclosure in which the assembly is disposed remains assembled.

2. Background Information

There are a number of applications where it is required that the operation of two circuit breakers be coordinated such that only one circuit breaker can be in the closed, operating position at one time. For example, providing a power-consuming load with electrical power from either of two different sources, such as a commercial power system and an auxiliary supply. It is imperative in such applications that only one circuit breaker be in the closed, operating position at one time. A device that prevents both circuit breakers from being in the operating position is called an interlock.

Circuit breaker interlocks are known which couple the actuating means, for example, operating handles, of circuit breakers whose operation is to be coordinated. One common type of interlock assembly, see e.g. U.S. Pat. No. 5,977,492, includes a sliding panel attached to a shroud. The shroud is disposed over top of the circuit breaker handles. The sliding panel is slidably attached to the shroud and includes cut outs and/or an edge that moves between a position wherein a first circuit breaker handle is blocked and a second circuit breaker handle is free to move and a position wherein the first circuit breaker handle is free to move and the second circuit breaker handle is blocked. As second common type of interlock assembly, see e.g. U.S. Pat. No. 6,043,439, utilizes a sliding bar that moves between a position wherein a first circuit breaker handle is blocked and a second circuit breaker handle is free to move and a position wherein the first circuit breaker handle is free to move and the second circuit breaker handle is blocked. Both the panel type and bar type interlock assemblies, however, have a common disadvantage; both are attached to the exposed portion of the circuit breaker or an exposed portion of the enclosure in which the circuit breaker is disposed. That is, both types of interlock assemblies are typically attached to the top side of the circuit breaker.

Interlock assemblies need to be removed when a circuit breaker is replaced or repaired. As such, the interlock assembly is coupled to the circuit breaker or enclosure by removable fasteners. This is a disadvantage, however, when the interlock assembly may be easily removed. That is, technicians or others may accidentally or intentionally remove the interlock assembly at an improper time, such as when both circuit breakers are still coupled to live circuits. Once the interlock assembly has been removed, there is a great danger that both circuit breakers may be closed at one time.

There is, therefore, a need for a removal deterrence structure for an interlock assembly so that interlock assembly cannot be easily removed from the circuit breakers which the interlock protects.

There is a further need for a removal deterrence structure for an interlock assembly which can only be removed normally during maintenance operations.

There is a further need for a removal deterrence structure for an interlock assembly that cannot be removed while the enclosure in which the circuit breakers are disposed is assembled.

SUMMARY OF THE INVENTION

These needs, and others, are addressed by the present invention which provides a removal deterrence structure for an interlock assembly so that the interlock assembly cannot be easily removed while the enclosure in which the circuit breakers are disposed remain assembled. One means of preventing the removal of the interlock assembly is to have the fasteners, which are preferably screws, that couple the interlock assembly to the circuit breakers or the enclosure located on the sides of the circuit breaker or extending in a direction perpendicular to the sides of the circuit breakers. Further, the enclosure in which the circuit breakers are disposed is sized so that the sidewall of the enclosure is adjacent to the fasteners. When the fasteners are disposed in such a manner, the fasteners cannot be accessed from an axial direction. Thus, the fasteners cannot be easily removed as the enclosure in which the circuit breakers are disposed will typically block access to the fasteners. Thus, in order to remove the interlock assembly, the enclosure must be disassembled first. Because disassembly of the enclosure is a time consuming task which is not performed regularly, there is less of a chance that a technician or another will accidentally or intentionally remove the interlock assembly.

The interlock assembly may be either a sliding plate type interlock assembly or a bar type interlock assembly so long as the fasteners that couple the interlock assembly to the enclosure or the circuit breakers extend in a direction parallel to the face, or top side, of the circuit breakers. Alternatively, the invention may be practiced with fasteners that extend in a direction perpendicular to the top side of the circuit breaker so long as the enclosure is structured to prevent access to the fasteners. For example, the enclosure may have guard tabs that extend over the fasteners or a protective lip that extends over the fasteners.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
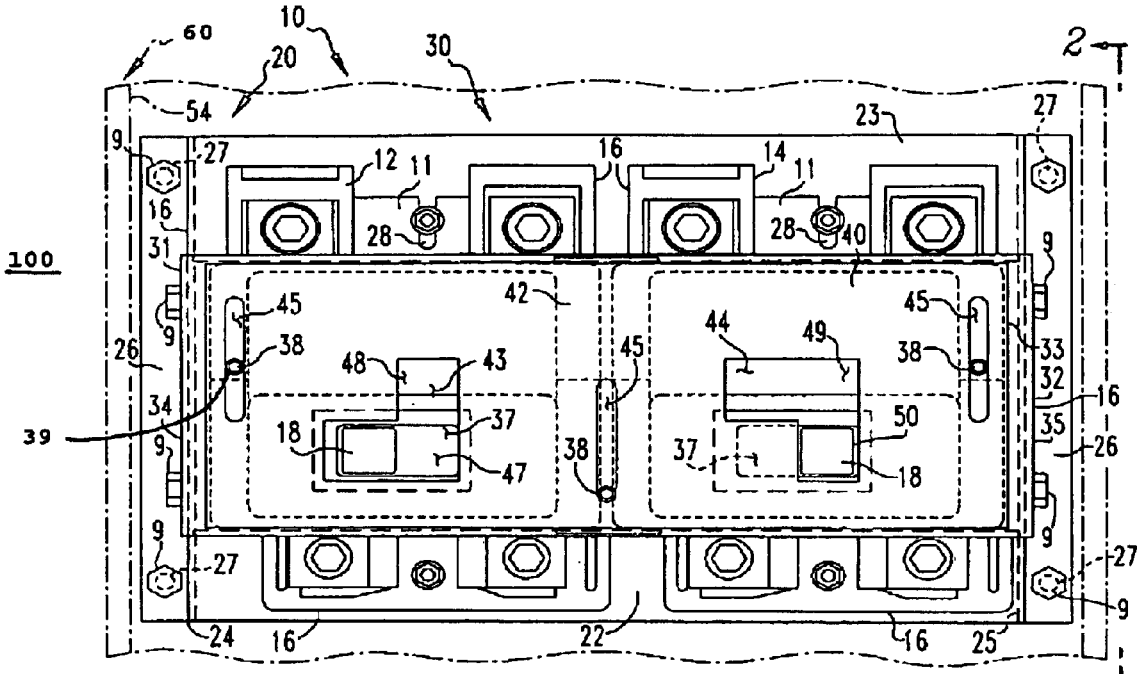
FIG. 1 is a top view of an alternate power source assembly with the interlock assembly in a first position.
Figure 2:
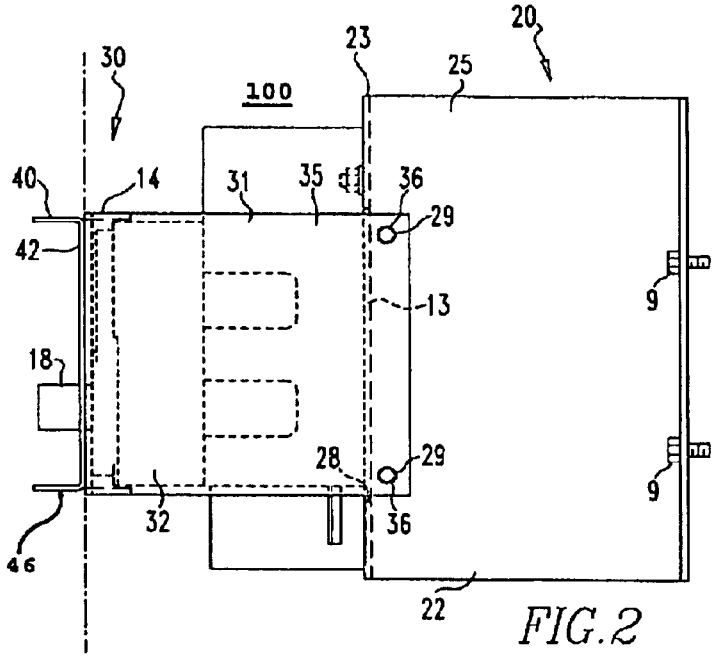
FIG. 2 is a side view of an alternate power source assembly with the interlock assembly in a first position.
Figure 3:
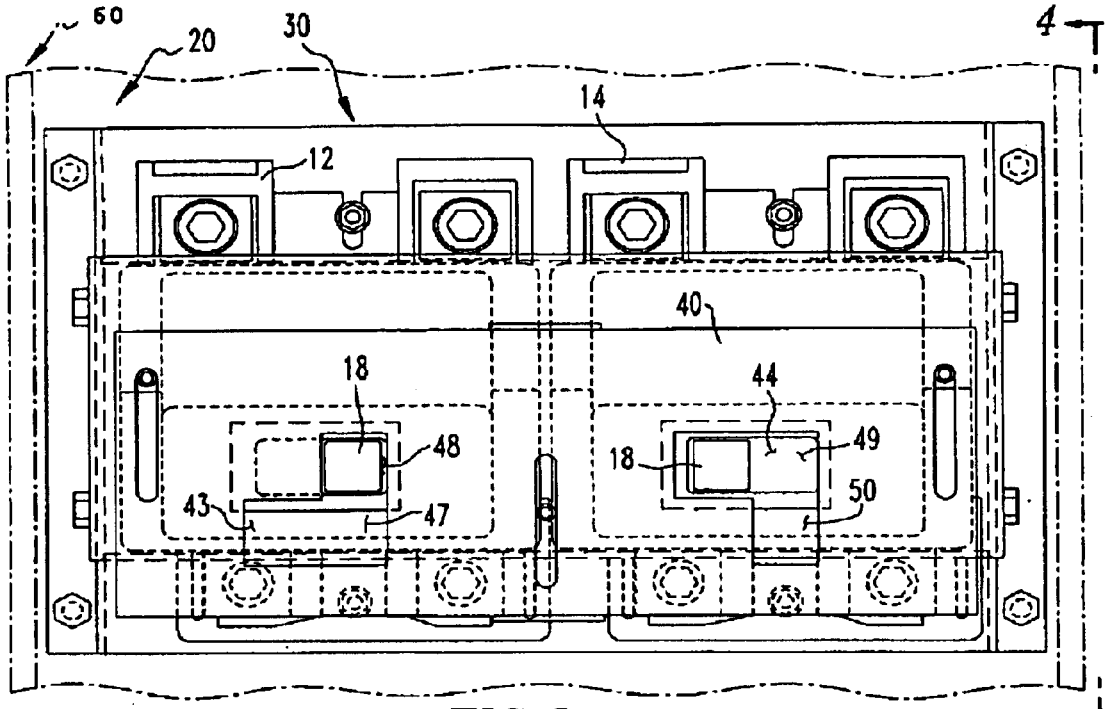
FIG. 3 is a top view of an alternate power source assembly with the interlock assembly in a second position.
Figure 4:
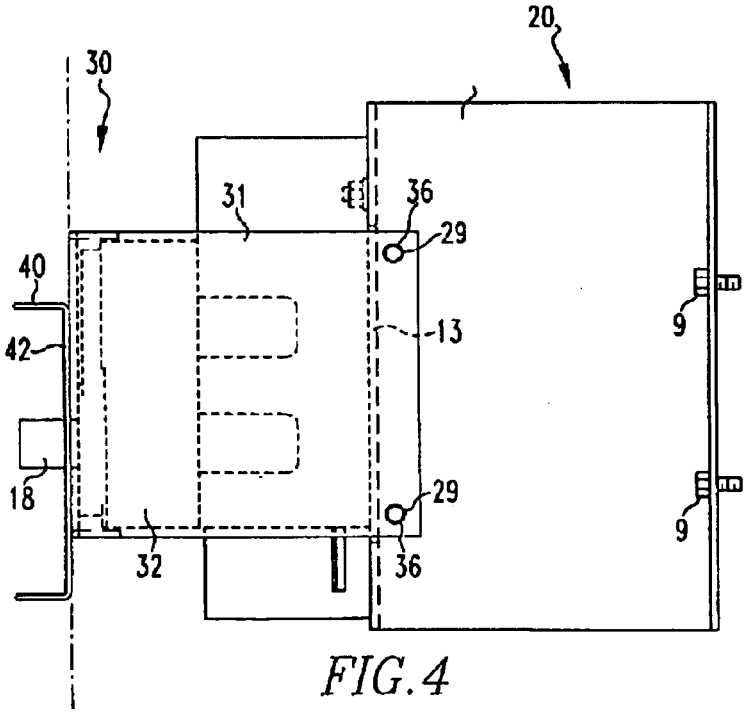
FIG. 4 is a side view of an alternate power source assembly with the interlock assembly in a second position.

As used herein, a "screw" is any type of fastener that is engaged from an axial direction and includes, but is not limited to, slot screws, Phillips head screws, and set screws.

As shown on FIGS. 1–4, an alternate power source assembly 10 includes a first and second circuit breaker 12, 14, a mounting assembly 20, and an interlock assembly 30 having a shroud assembly 31 and a slide assembly 40. The slide assembly 40 may be either the plate type or the bar type. As detailed hereinafter, the specification will describe a plate type slide assembly 40. The alternate power source assembly 10 is structured to be disposed within an enclosure 60. The combination of the alternate power source assembly 10 and the enclosure 60 act as a removal deterrence structure 100 to resist the removal of the interlock assembly 30. That is, the interlock assembly 30 is structured to be positioned over the circuit breakers 12, 14 and coupled to the circuit breakers 12, 14 or enclosure 60 by a means that cannot be decoupled from the circuit breakers 12, 14 or enclosure 60 unless the enclosure 60 is disassembled.

Each circuit breaker 12, 14, has a generally flat top side 11, a bottom side 13 and a plurality, typically four, of perpendicular sidewalls 16. Each circuit breaker 12, 14 also includes a handle 18. The handle 18 is structured to pivot through an arc. As is known in the art, within each circuit breaker 12, 14 are a pair of main contacts (not shown). The contacts may be closed, allowing electricity to flow through the circuit breaker 12, 14, or the contacts may be open, preventing electricity from flowing through the circuit breaker 12, 14. Each pivoting handle 18 is structured to move as indicated by the double headed arrow, between a first position, wherein the circuit breaker 12, 14 is open, and a second position, wherein the circuit breaker 12, 14 is closed. For example, as shown in FIG. 1, the pivoting handle 18 of the first circuit breaker 12 is in the second position, thus the first circuit breaker 12 is closed, and the pivoting handle 18 of the second circuit braker 14 is in the first position, thus the second circuit breaker 14 is open.

The mounting assembly 20 includes a U-shaped bracket 22 having a base member 23 and two side members 24, 25. The mounting assembly side members 24, 25 are generally perpendicular to the base member 23. The mounting assembly side members 24, 25 may have generally perpendicular tabs 26 at the distal end of the side members 24, 25. The tabs 26 have one or more mounting fastener openings 27 disposed there on. The mounting assembly base member 23 also includes one or more circuit breaker fastener openings 28. The mounting assembly side members 24, 25 further have interlock assembly fastener openings 29 disposed adjacent to the mounting assembly base member 23. The interlock assembly fastener openings 29 extend in a direction generally parallel to the plane of the mounting assembly base member 23.

The shroud assembly 31 also includes a U-shaped bracket 32 having a base member 33 and two side members 34, 35. The shroud assembly side members 34, 35 are generally perpendicular to the base member 33. There are mounting assembly fastener openings 36 disposed at the distal ends of the shroud assembly side members 34, 35. The mounting assembly fastener openings 36 extend in a direction generally parallel to the shroud assembly base member 33. The mounting assembly fastener openings 36 are sized and spaced to correspond to the interlock assembly fastener openings 29 disposed on the mounting assembly side members 24, 25. The shroud assembly side members 34, 35 have a length such that, when the shroud assembly 31 and first and second circuit breakers 12, 14 are coupled to the mounting assembly 20, the shroud assembly base member 33 is disposed adjacent to the circuit breaker top side 11. The shroud assembly base member 33 includes two circuit breaker handle openings 37. The circuit breaker handle openings 37 have a sufficient length to allow the circuit breaker handles 18 to pivot between their first and second positions. The shroud assembly base member 33 also includes a plurality of guide posts 38. The guide posts 38 extend generally perpendicular to the shroud assembly base member 33 and in a direction opposite of the shroud assembly side members 34, 35. The guide posts 38 include a retaining means such as a head 39.

The slide assembly 40 includes a plate 42 having first and second L-shaped cut outs 43, 44, a plurality of guide post slots 45 and a handle 46. The first L-shaped cut out 43 includes a pivoting slot portion 47 and a locking slot portion 48. The second L-shaped cut out 44 also includes a pivoting slot portion 49 and a locking slot portion 50. The first and second pivoting slot portions 47, 49 are rectangular and are about the same size as the circuit breaker handle openings 37. The longitudinal axis of the first and second pivoting slot portions 47, 49 extend parallel to each other, but are not aligned with each other. The first L-shaped cut out locking slot portion 48 is disposed to one side of the first L-shaped cut out pivoting slot portion 47 and is further aligned with the longitudinal axis of the second L-shaped cut out pivoting slot portion 49. The second L-shaped cut out locking slot portion 50 is disposed to the side of the second L-shaped cut out on the side opposite of the first L-shaped cut out locking slot portion 48. The second L-shaped cut gut locking slot portion 50 is further aligned with the longitudinal axis of the first L-shaped cut out pivoting slot portion 47. Each guide post 45 slot is an elongated slot which extends in a direction perpendicular to the longitudinal axis of the first and second L-shaped cut out pivoting slot portions 47, 49.

When assembled, the alternate power source assembly 10 has the first and second circuit breakers 12, 14 coupled to the mounting assembly base member 23 by fasteners 9. The fasteners 9 extend through each circuit breaker 12, 14 and the mounting assembly base member 23. The interlock assembly 30 is coupled to the mounting assembly 20 by fasteners 9 extending through the aligned interlock assembly fastener openings 29 and mounting assembly fastener openings 36 located on the shroud assembly 31. Thus, the shroud assembly 31 is disposed over the first and second circuit breakers 12, 14. The first and second circuit breaker pivoting handle 18 extend through the circuit breaker handle openings 37. The slide assembly 40 is slidably coupled to the shroud assembly 31 by the guide posts 38. That is, a guide post 38 extends through each elongated guide post slot 45 and the guide post head 39 secures the slide assembly 40. Thus, the slide assembly plate 42 is disposed immediately adjacent to the shroud assembly base member 33 and may be moved between a first and second position. As noted above, the combination of the shroud assembly 31 and the slide assembly 40 comprise the interlock assembly.

The handle 18 of the first circuit breaker 12 extends through the first L-shaped cut out 43. The handle 18 of the second circuit breaker 14 extends through the second L-shaped cut out 44. Because of the shape and alignment of the first and second L-shaped cut outs 43, 44, one circuit breaker handle 18 will be disposed in the pivoting slot portion 47, 49 and the other circuit breaker handle 18 is disposed in the locking slot portion 48, 50. That is, the first and second L-shaped cut outs 43, 44 are sized and aligned so that only one circuit breaker handle 18 may be disposed in the pivoting slot portion 47, 49 of either the first or second L-shaped cut out 43, 44. Additionally, when the slide assembly 40 is coupled to the shroud assembly 31, the locking slot portion 48, 50 of the L-shaped cut out 43, 44 is disposed adjacent to the segment of the pivoting slot portion 47, 49 that corresponds to the first position of the circuit breaker handles 18. The circuit breaker handle 18 that is in the pivoting slot portion 47, 49 of either the first or second L-shaped cut out 43, 44 is free to move between the circuit breaker handle 18 first and second positions. The other circuit breaker handle 18 is disposed in the locking portion 48, 50 of the other L-shaped cut out 43, 44 and cannot be pivoted. The first and second L-shaped cut outs 43, 44 are disposed on the slide assembly plate 42 relative to the guide post slots 45 so that when a circuit breaker handle 18 is in the locking portion 48, 50, the circuit breaker 12, 14 is in the open position. When a circuit breaker handle 18 is in the second position, the slide assembly 40 cannot be moved from the slide assembly first position to the slide assembly second position as circuit breaker handle 18 in the second position blocks the path of travel of the slide assembly 40.

Figure 5A:
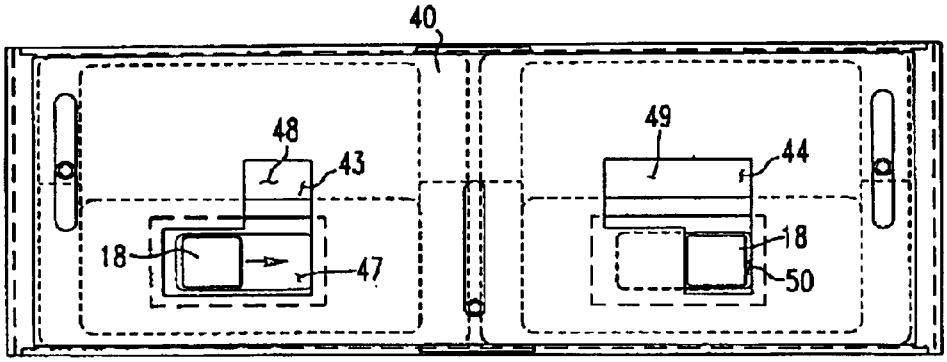
FIGS. 5A–5D are schematic views of the alternate power source assembly in operation.
Figure 5B:
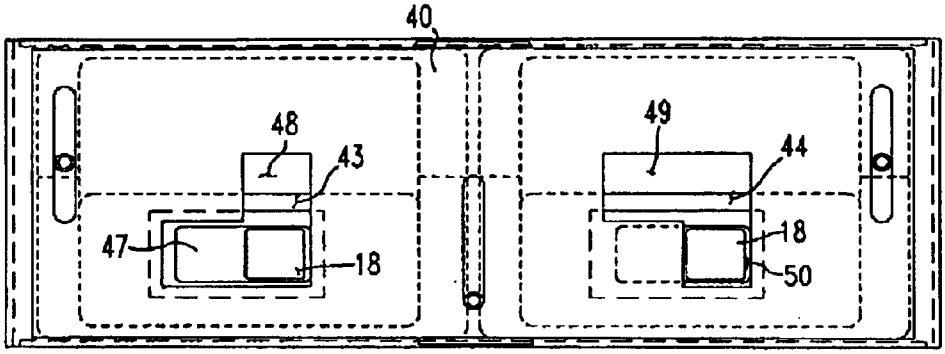

As shown in FIGS. 5A–5D, the alternate power source assembly 10 operates as follows. Initially, as shown in FIG. 5A, the slide assembly 40 is in the first position, and the handle 18 for the first circuit breaker 12 is in pivoting slot portion 47 of the first U-shaped cut out 43. The handle 18 for the first circuit breaker 12 is in the second position, that is, with the first circuit breaker 12 closed. The handle 18 for the first circuit breaker 12 prevents the slide assembly 40 from moving between the first and second positions. The handle 18 for the second circuit breaker 14 is in locking slot portion 50 of the second L-shaped cut out 44 and, thus, the second circuit breaker 14 is open. To switch to the alternate power source, the user must utilize the interlock assembly 30 and move the slide assembly 40 from the first position to the second position. To do this, the user must move the handle 18 for the first circuit breaker 12 from the second position to the first position, as shown in FIG. 5B. Thus, both the handles 18 for the first and second circuit breakers 12, 14 are in the first position and the circuit breakers 12, 14 are open. Additionally, the handle 18 for the first circuit breaker 12 no longer prevents movement of the slide assembly 40. That is, the handle 18 for the first circuit breaker 12 is now adjacent to the locking portion 48 or the first cut out 43.

Figure 5C:
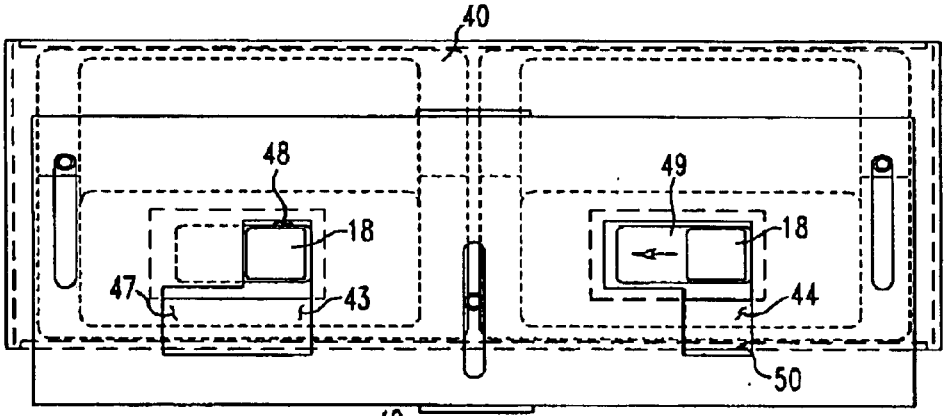
Figure 5D:
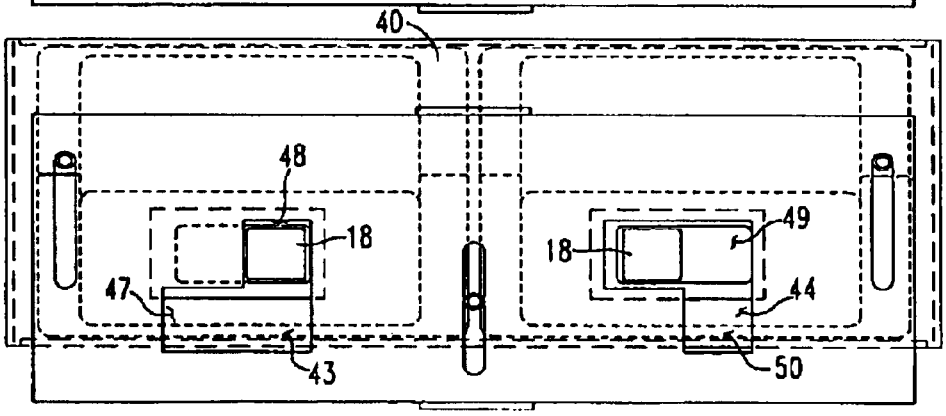

The user may then use the handle 46 to move the slide assembly 40 from the first position to the second position. That is, as shown in FIG. 5C, the user slides the slide assembly 40 so that the handle 18 of the first circuit breaker 12 is located in the locking portion 48 of the first cut out 43 and the handle 18 of the second circuit breaker 14 is located in the pivoting slot portion 49 of the second L-shaped cut out 44. At this point, the user moves the handle 18 of the second circuit breaker 14 into the second position, as shown in FIG. 5D, thereby closing the second circuit breaker 14. In the final configuration, the slide assembly 40 is in the second position with the handle 18 of the first circuit breaker 12 is in the circuit breaker handle first position and disposed in the locking portion 48 of the first L-shaped cut out 43 and the handle 18 of the second circuit breaker 14 is in the circuit breaker handle second position and disposed in the pivoting slot portion 49 of the second L-shaped cut out 44. The handle 18 of the second circuit breaker 14 now prevents the slide assembly 40 from moving into the first position.

Figure 6:
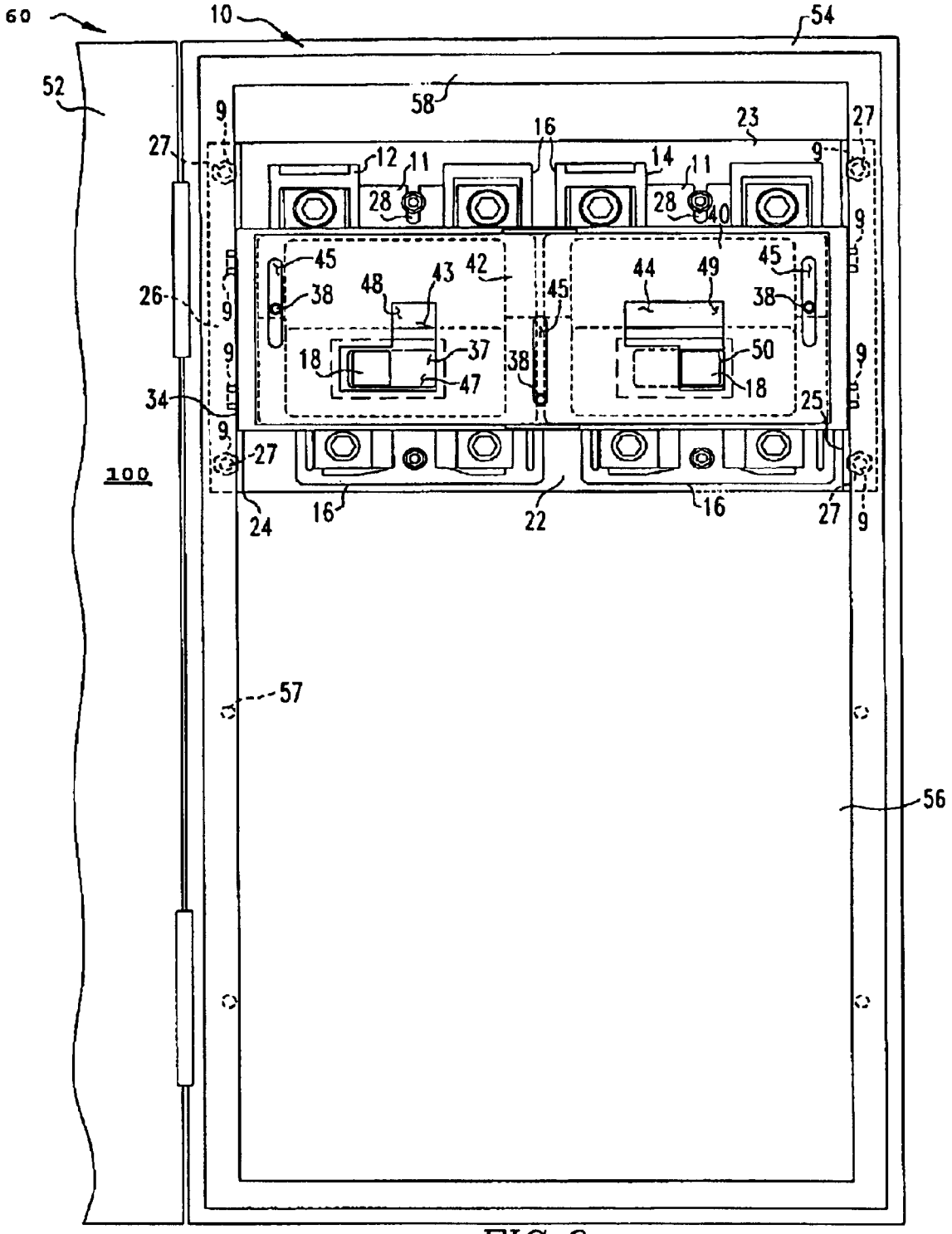
FIG. 6 is a front view of the alternate power source assembly disposed within an enclosure.

As shown in FIG. 6, the alternate power source assembly 10 is disposed within an enclosure 60 such as a breaker box. The enclosure 60 includes a front door, 52, plurality of sidewalls 54 and a back wall 56. The enclosure sidewalls 52 are coupled to the back wall 56 by fasteners (not shown) which may be removed. Thus, the enclosure 60 may be disassembled. The back wall 56 includes fastener openings 57. The sidewalls 54 of the enclosure may also include a perpendicular lip 58, that extends into the housing. The sidewalls 54 are spaced so that, when the alternate power source assembly 10 is in the enclosure 60, the sidewalls 54 are immediately adjacent to the mounting assembly side members 24, 25. The alternate power source assembly 10 is mounted on the back wall 56 of the enclosure by fasteners 9 that extend through the mounting fastener openings 27 on the mounting assembly 20 and into the back wall fastener openings 57. Preferably, this construction requires that the alternate power source assembly 10 be attached to the back wall 56 prior to the installation of the enclosure sidewalls 54. The fasteners 9 are, preferably, screws or other fasteners that must be accessed from an axial direction. As such, because the sidewalls 54 are disposed close to the assembly side members 24, 25 it is very difficult to access the fasteners 9 that attach the shroud assembly 31, and therefore the interlock assembly 30, to the mounting assembly 20. Thus, the fasteners 9 coupling the interlock assembly 30 to the circuit breakers 12, 14 arc fasteners 9 that cannot be easily accessed from the exposed side of the circuit breakers 12, 14 and a user is not able to easily remove the interlock assembly 30.

Alternatively, if a bolt type fastener 9, or any such fastener that is accessed from the lateral sides of the fastener head, is used, the fastener 9 preferably has a length sufficient so that the fastener 9 cannot be backed out of the fastener opening 27 without contacting the enclosure sidewall 54 If the enclosure sidewalls, 54 include a lip 58 which extends generally parallel to the enclosure back wall 56 and extend over the fasteners 9, access to the fasteners 9 that attach the shroud assembly 31 to the mounting assembly 20 is even more difficult. Thus, the combination of the location of the fasteners 9 that attach the interlock assembly 30 to the mounting assembly 20 and the enclosure housing act as the deterrence structure 100 to prevent removal of the fasteners 9 that hold the interlock assembly 30 in place.

Figure 7:
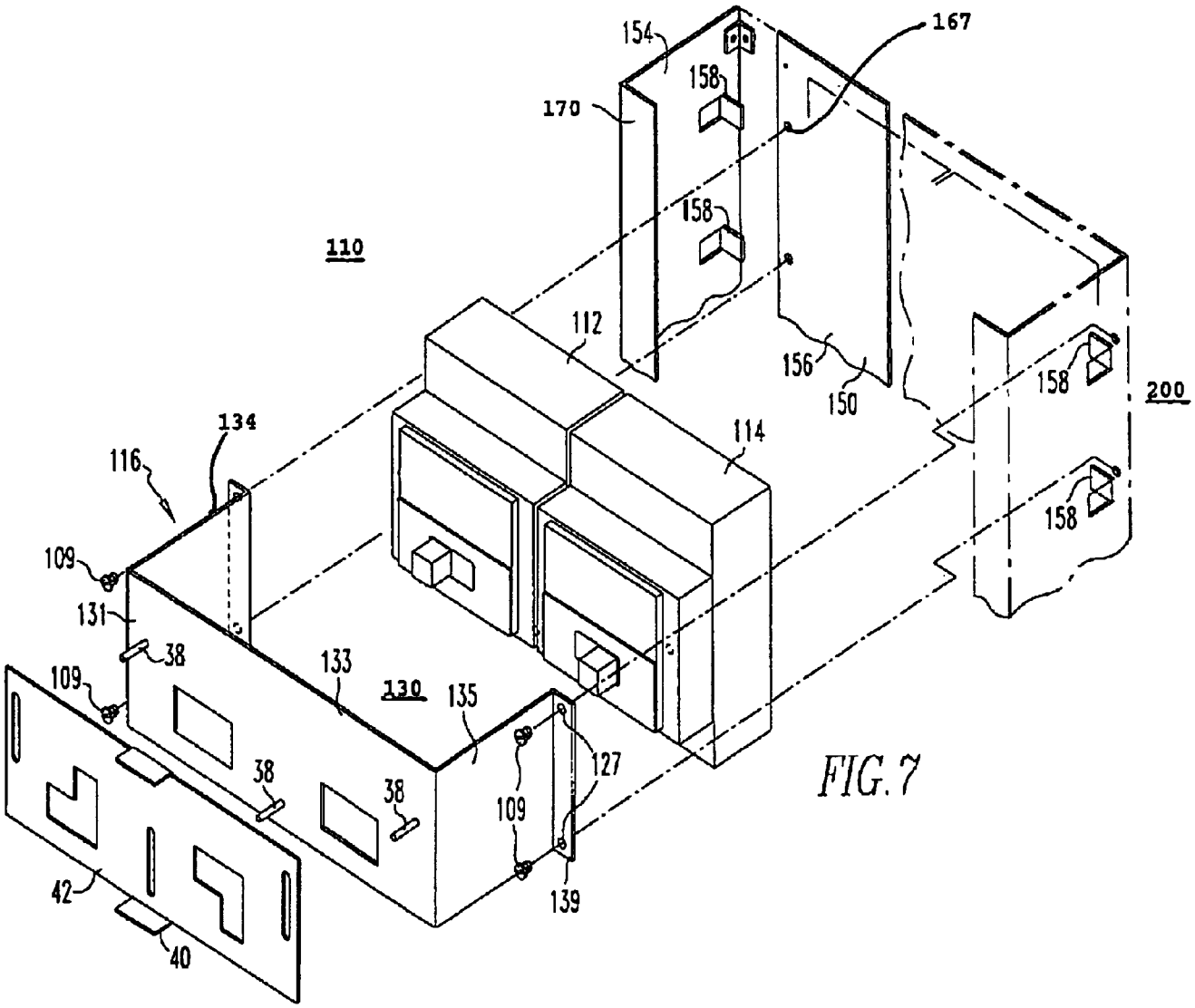
FIG. 7 is a front view on an alternate embodiment.

An alternate embodiment of the invention is shown in FIG. 7. Generally, the components of the alternate embodiment are similar to the components identified above and shall use reference numbers increased by 100. This second embodiment is different in the following aspects. First, the alternate power source assembly 110 does not include a mounting assembly. Instead, the circuit breakers 112, 114 are coupled directly to the back wall 156 of an enclosure 150. Additionally, the shroud assembly 131 includes a mounting lip 139 located at the distal end of each side member 134, 135. Each mounting lip 139 extends in a direction generally perpendicular to the side member 134, 135 and in a direction away from the base member 133. Each mounting lip includes one or more mounting fastener openings 127. The back wall 156 of the enclosure 150 includes fastener openings 167. The interlock assembly 130 is coupled to the back wall 156 by fasteners 109 that extend through the mounting fastener openings 127 into the back wall fastener openings 167.

The enclosure sidewalls 154 include a plurality of guard tabs 158 located at the location of each back wall fastener opening 167. The guard tabs 158 are tabs which are formed by cutting and bending a portion of the sidewall 154 to be generally perpendicular to the sidewall 154. That is, the sidewall 154 is cut, for example in a U-shape, and then bent to form a guard tab 158. Alternatively, an L-shaped tab member may be attached to tie sidewall 154 to form the guard tab 170. The guard tab 158 is sized so that, when the enclosure 150 is assembled, the guard tab 158 will be disposed over the mounting fastener 109. Thus, to assemble the alternate power source assembly 110 and enclosure 150, the interlock assembly 130 is mounted on the back wall 156 prior to assembling the sidewalls 154. When the sidewalls 154 are installed, the guard tabs 158 or 170 will be disposed over top of the mounting fasteners 109. Thus, in this embodiment, the combination of the location of the fasteners 109 that attach the interlock assembly 130 guard tabs 158 or 170 act as the deterrence structure 200 to prevent removal of the fasteners 109 that hold the interlock assembly 130 in place.

While specific embodiments of the invention have been described in detail, it will be appreciated by those skilled in the art that various modifications and alternatives to those details could be developed in light of the overall teachings of the disclosure. Accordingly, the particular arrangements disclosed arc meant to be illustrative only and not limiting as to the scope of invention which is to be given the full breadth of the claims appended and any and all equivalents thereof.

What is claimed is:

1. A removal deterrence structure for a pair of circuit breakers having an interlock assembly comprising:

an enclosure;

a first circuit breaker disposed within said enclosure, said first circuit breaker having a handle structured to move from a first position, wherein said first circuit breaker is open, and a second position, wherein said first circuit breaker is closed;

a second circuit breaker disposed within said enclosure, said second circuit breaker having a handle structured to move from a first position, wherein said second circuit breaker is open, and a second position, wherein said second circuit breaker is closed;

an interlock assembly disposed within said enclosure and structured to allow only one of said circuit breaker handles to be in said second position at a time;

a means for coupling said interlock assembly to said circuit breakers so that said interlock assembly is positioned over said circuit breakers and said means cannot be decoupled from said circuit breakers unless said enclosure is disassembled;

wherein said means for coupling said interlock assembly to said circuit breakers are fasteners that cannot be accessed from an axial direction;

wherein said circuit breakers have a top side;

said fasteners extend in a direction generally parallel to the plane of said top side;

said enclosure includes a sidewall; and said enclosure sidewall disposed immediately adjacent to said fasteners.

2. A removal deterrence structure for a pair of circuit breakers having an interlock assembly comprising:

an enclosure;

a first circuit breaker disposed within said enclosure, said first circuit breaker having a handle structured to move from a first position, wherein said first circuit breaker is open, and a second position, wherein said first circuit breaker is closed;

a second circuit breaker disposed within said enclosure, said second circuit breaker having a handle structured to move from a first position, wherein said second circuit breaker is open, and a second position, wherein said second circuit breaker is closed;

an interlock assembly disposed within said enclosure and structured to allow only one of said circuit breaker handles to be in said second position at a time;

a means for coupling said interlock assembly to said circuit breakers so that said interlock assembly is positioned over said circuit breakers and said means cannot be decoupled from said circuit breakers unless said enclosure is disassembled;

wherein said means for coupling said interlock assembly to said circuit breakers is a fastener;

wherein said circuit breakers have a top side;

said fastener extends in a direction generally parallel to the plane of said top side.

said enclosure includes a sidewall;

said enclosure sidewall disposed immediately adjacent to said fastener; and said fastener has a sufficient length so that said fastener cannot be backed out without contacting said enclosure sidewall.

3. A removal deterrence structure for a pair of circuit breakers having an interlock assembly comprising:

an enclosure;

a first circuit breaker disposed within said enclosure, said first circuit breaker having a handle structured to move from a first position, wherein said first circuit breaker is open, and a second position, wherein said first circuit breaker is closed;

a second circuit breaker disposed within said enclosure, said second circuit breaker having a handle structured to move from a first position, wherein said second circuit breaker is open, and a second position, wherein said second circuit breaker is closed;

an interlock assembly disposed within said enclosure and structured to allow only one of said circuit breaker handles to be in said second position at a time;

said interlock assembly structured to be positioned over said circuit breakers and coupled to said enclosure by a means that cannot be decoupled from said enclosure unless said enclosure is disassembled;

wherein said circuit breakers have a top side;

wherein said interlock-assembly includes fasteners;

said fasteners extend in a direction generally parallel to the plane of said top side;

said enclosure includes a sidewall;

said enclosure sidewall disposed immediately adjacent to said fasteners;

said fasteners have a sufficient length so that said fasteners cannot be backed out without contacting said enclosure sidewall.

4. An interlock assembly for two or more circuit breakers disposed in an enclosure, said enclosure having one or more sidewalls, said circuit breakers having a generally flat top side with a pivotable handle, each said circuit breaker handle structured to move from a first position, wherein said circuit breaker is open, and a second position, wherein said circuit breaker is closed, said interlock assembly comprising:

a shroud assembly structured to be disposed over said two or more circuit breakers and having two side members extending in a direction generally perpendicular to said circuit breaker top side and a base member extending in a direction generally parallel to said circuit breaker top side;

said shroud assembly structured to be positioned over said circuit breakers by fasteners which pass through said side members, said fasteners disposed immediately adjacent to said enclosure sidewall;

a slide assembly slidably coupled to said shroud assembly;

said slide assembly structured to allow only one circuit breaker handle to be closed at a time;

wherein said shroud assembly is structured to be coupled to the sides of said circuit breakers by said fasteners extending in a direction generally parallel to said top side; and said enclosure sidewall is disposed immediately adjacent to said fasteners.

5. An alternate power source assembly comprising:

an enclosure having a plurality of sidewalls;

a first circuit breaker having a top side and sidewalls and a pivoting operating handle disposed on said first circuit breaker top side, said first circuit breaker handle structured to move from a first position, wherein said first circuit breaker is open, and a second position, wherein said first circuit breaker is closed;

a second circuit breaker having a top side and sidewalls and a pivoting operating handle disposed on said second circuit breaker top side, said second circuit breaker handle structured to move from a first position, wherein said second circuit breaker is open, and a second position, wherein said second circuit breaker is closed;

a mounting assembly coupled to said enclosure and having a U-shaped bracket having a base member and two side members;

a shroud assembly;

a slide assembly slidably coupled to said shroud assembly;

said shroud assembly structured to be positioned over said circuit breakers and coupled to said enclosure by a means that cannot be decoupled from said enclosure unless said enclosure is disassembled;

wherein said mounting assembly includes a generally perpendicular tab at the distal end of each said side member, each said tab having one or more fastener openings;

said mounting assembly coupled to said enclosure back wall by fasteners extending through said mounting assembly tab openings; and said enclosure sidewalls having one or more guard tabs extending generally perpendicular to said sidewall and extending over each said mounting assembly tab openings.

6. An alternate power source assembly comprising.

an enclosure having a plurality of sidewalls;

a first circuit breaker having a top side and sidewalls and a pivoting operating handle disposed on said first circuit breaker top side, said first circuit breaker handle structured to move from a first position, wherein said first circuit breaker is open, and a second position, wherein said first circuit breaker is closed;

a second circuit breaker having a top side and sidewalls and a pivoting operating handle disposed on said second circuit breaker top side, said second circuit breaker handle structured to move from a first position, wherein said second circuit breaker is open, and a second position, wherein said second circuit breaker is closed;

a mounting assembly coupled to said enclosure and having a U-shaped bracket having a base member and two side members;

a shroud assembly structured to be disposed over said two or more circuit breakers and having two side members extending in a direction perpendicular to said circuit breaker top side and a base member extending in a direction parallel to said circuit breaker top side;

said shroud assembly structured to be positioned over said circuit breakers and coupled to said mounting assembly by fasteners which pass through said side members, said fasteners disposed immediately adjacent to said enclosure sidewall;

a slide assembly slidably coupled to said shroud assembly;

said slide assembly structured to allow only one circuit breaker handle to be closed at a time;

wherein said slide assembly has two or more L-shaped cutouts;

said L-shaped cutouts positioned so that only one circuit breaker handle may be in said second position at one time;

wherein said slide assembly is structured to move between a first position and a second position;

there is a first L-shaped cutout and a second L-shaped cutout;

each said L-shaped cutout have a pivoting slot portion, and a locking slot portion;

wherein said locking slot portion of one cutout is aligned with the longitudinal axis of the pivoting slot portion of the other cutout;

wherein said shroud assembly is structured to be coupled to the sides of said circuit breakers by fasteners extending in a direction generally parallel to said top side; and said enclosure sidewall is disposed immediately adjacent to said fasteners.

* * * * *